US005956555A

United States Patent [19]

Chen et al.

[11] Patent Number: 5,956,555

[45] Date of Patent: Sep. 21, 1999

[54] FUSING BELT HAVING POLYURETHANE RELEASE LAYER

[75] Inventors: Jiann H. Chen, Fairport; Charles C. Anderson, Penfield, both of N.Y.; Andy H. Tsou, Houston, Tex.

[73] Assignee: Eastman Kodak Company, Rochester, N.Y.

[21] Appl. No.: 09/123,007

[22] Filed: Jul. 27, 1998

[51] Int. Cl.[6] ..... G03G 15/20

[52] U.S. Cl. ..... 399/329; 428/423.1

[58] Field of Search ..... 399/320, 328, 399/329, 330, 333; 219/216; 428/423.1, 423.5, 423.7, 425.8

[56] References Cited

U.S. PATENT DOCUMENTS

| | | | |
|---|---|---|---|
| 2,454,043 | 11/1948 | Dimsdale et al. | 95/7 |
| 2,588,765 | 3/1952 | Robijns | 95/9 |
| 2,732,305 | 1/1956 | Richman et al. | 95/8 |
| 2,976,148 | 3/1961 | Walford | 96/87 |
| 3,042,222 | 7/1962 | Lehmann | 212/3 |
| 3,042,522 | 7/1962 | Ben-Ezra | 96/87 |
| 3,080,317 | 3/1963 | Tallet et al. | 252/49.6 |
| 3,121,060 | 2/1964 | Duane | 252/56 |
| 3,206,311 | 9/1965 | Campbell et al. | 96/87 |
| 3,489,567 | 1/1970 | McGraw | 96/85 |
| 3,502,473 | 3/1970 | Snellman et al. | 96/67 |
| 3,933,516 | 1/1976 | Mackey | 106/131 |
| 4,004,927 | 1/1977 | Yamamoto et al. | 96/67 |
| 4,427,964 | 1/1984 | Ruegsegger | 337/231 |
| 5,089,363 | 2/1992 | Rimai et al. | 430/45 |
| 5,124,755 | 6/1992 | Hediger | 355/285 |
| 5,200,284 | 4/1993 | Chen et al. | 430/33 |
| 5,233,008 | 8/1993 | Chen et al. | 528/33 |
| 5,258,256 | 11/1993 | Aslam et al. | 430/124 |
| 5,330,840 | 7/1994 | Chen et al. | 428/423.1 |
| 5,362,833 | 11/1994 | Chen et al. | 528/25 |
| 5,386,281 | 1/1995 | Mitani et al. | 355/290 |
| 5,465,146 | 11/1995 | Higashi et al. | 355/285 |
| 5,529,847 | 6/1996 | Chen et al. | 428/413 |
| 5,708,948 | 1/1998 | Chen et al. | 399/329 |
| 5,778,295 | 7/1998 | Chen et al. | 399/329 |
| 5,781,840 | 7/1998 | Chen et al. | 399/324 |

FOREIGN PATENT DOCUMENTS

| | | |
|---|---|---|
| 1284294 | 11/1968 | Germany . |
| 1284295 | 11/1968 | Germany . |
| 955061 | 4/1964 | United Kingdom . |
| 1143118 | 2/1969 | United Kingdom . |
| 1198387 | 7/1970 | United Kingdom . |
| 1263722 | 2/1972 | United Kingdom . |
| 1320565 | 6/1973 | United Kingdom . |
| 1320756 | 6/1973 | United Kingdom . |
| 1320757 | 6/1973 | United Kingdom . |
| 1430997 | 6/1974 | United Kingdom . |
| 1466304 | 3/1977 | United Kingdom . |

OTHER PUBLICATIONS

Wicks et al, Organic Coatings, Science & Technology, vol. 1, John Wiley & Sons, New York, 1992, pp. 198–200

*Primary Examiner*—Arthur T. Grimley
*Assistant Examiner*—William A. Noē
*Attorney, Agent, or Firm*—Raymond L. Owens

[57] ABSTRACT

A toner fuser belt for use with electrophotographic apparatus including a thermally conductive substrate through which heat is applied; and a toner release layer formed over the substrate; and including an aliphatic cross-linked polyurethane which is stable at fusing temperatures and wherein the aliphatic cross-linked polyurethane is selected to provide good adhesion to the substrate, inorganic material selected to increase toner fuser belt durability and being in an amount 20 to 60 percent by volume of the toner release layer, and a lubricant which reduces surface energy to thereby promote toner release of the toner release layer.

4 Claims, 2 Drawing Sheets

FUSING BELT HAVING POLYURETHANE RELEASE LAYER

CROSS REFERENCE TO RELATED APPLICATION

Reference is made to commonly assigned U.S. patent application Ser. No. 09/123,037 filed concurrently herewith, entitled "Fuser Belts With Adhesion Promoting Layer" by Chen et al, the teachings of which are incorporated herein by reference.

FIELD OF THE INVENTION

This invention relates to a fuser belt useful for heat-fixing a heat-softenable toner material to a receiver. More particularly, this invention relates to a fuser belt that resists scratching and wear and has excellent toner release properties to provide fused toner images having high gloss.

BACKGROUND OF THE INVENTION

Electrophotography can be used to create photographic quality multicolor toner images when the toner particles are small, that is, less than about 10 micrometers, and the receivers, typically papers, are smooth. Electrophotography typically involves the steps of charging a photoconductive element, exposing the photoconductive or dielectric element to create an electrostatic image, toning the electrostatic image, transferring the toner to a receiver, and fixing the toner to the receiver. A typical method of making a multicolor toner image involves trichromatic color synthesis by subtractive color formation. In such synthesis successive imagewise electrostatic images are formed on an element, each representing a different color, and each image is developed with a toner of a different color. Typically, the colors will correspond to each of the three primary colors (cyan, magenta and yellow) and black, if desired. The imagewise electrostatic images for each of the colors can be made successively on a photoconductive element by using filters for each color separation to reflect only the light corresponding to each color in the image to the photoconductive element. After developing each color separation, it can be transferred from the photoconductive element successively in registration with the other color toner images to an intermediate transfer member and then all the color toner images can be transferred in one step from the intermediate transfer member to a receiver. After all the color toners have been transferred to the receiver, the toners are fixed or fused to the receiver. To match the photographic quality produced using silver halide technology, it is preferred that these multicolor toner images have high gloss.

Commonly-assigned U.S. Pat. No. 5,258,256 discloses that toners having specified viscoelastic flow characteristics, as evidenced by a loss tangent of at least 1.2, used in a belt fusing system can provide desirable gloss. The belt in the belt fusing system, can be made of stainless steel or polyester. When polyester is used the belt can be formed solely of that material or it can be coated with a toner release layer. The outer surface of the fuser member can be aluminum, steel, various alloys, or polymeric materials, such as, thermoset resins and fluoroelastomers. Further, release agents may be used on the fuser belt. Commonly-assigned U.S. Pat. No. 5,708,948 shows an effective toner release layer coated on a substrate. This toner release layer has been found to be quite effective but there remain problems of its adhesion to the substrate.

The background art discloses several broad classes of materials useful for fuser belts. For example, commonly assigned U.S. Pat. Nos. 5,089,363; 5,362,833; 5,529,847; 5,330,840; 5,233,008; 5,200,284, and U.S. Pat. Nos. 5,465,146; 5,386,281; and 5,124,755 disclose fuser belts coated with toner release layers formed of silicone polymers. Commonly-assigned U.S. Pat. Nos. 5,089,363 and 5,708,948 disclose that fuser belts coated with a toner release layer formed of highly crosslinked polysiloxanes provide fused toner images having high gloss. Commonly-assigned U.S. Pat. No. 5,778,925, describes fuser belts containing a crosslinked, silicone resin intermediate layer and a toner release layer that comprises a silsesquioxane polymer.

While fuser belts described in the aforementioned prior art provide high gloss and good release there still is a need to improve the toner release layer and improve its wear property to promote belt life.

SUMMARY OF THE INVENTION

It is an object of the present invention to provide a fuser belt having a toner release layer that has improved wear life while having excellent toner release properties.

This object is achieved in a toner fuser belt for use with electrophotographic apparatus comprising:

(a) a thermally conductive substrate through which heat is applied; and (b) a toner release layer formed over the substrate; and including an aliphatic cross-linked polyurethane which is stable at fusing temperatures and wherein the aliphatic cross-linked polyurethane is selected to provide good adhesion to the substrate, inorganic material selected to increase toner fuser belt durability and being in an amount 20 to 60 percent by volume of the toner release layer, and a lubricant which reduces surface energy to thereby promote toner release of the toner release layer.

This fuser belt provides high gloss, long-life, and good release of the fused toner images and is scratch-resistant.

DESCRIPTION OF THE PREFERRED EMBODIMENTS

Fuser belts of this invention can be any size and can be used in any fuser belt system which comprises a fuser belt. Preferably the fuser belt system comprises a fuser belt which is trained around two or more rollers, and is in pressurized contact with another fuser member, preferably either another fuser belt or a fuser roller. Fuser belts of this invention can be used to contact the toner-bearing or non-toner-bearing side of a receiver.

Figure 1:
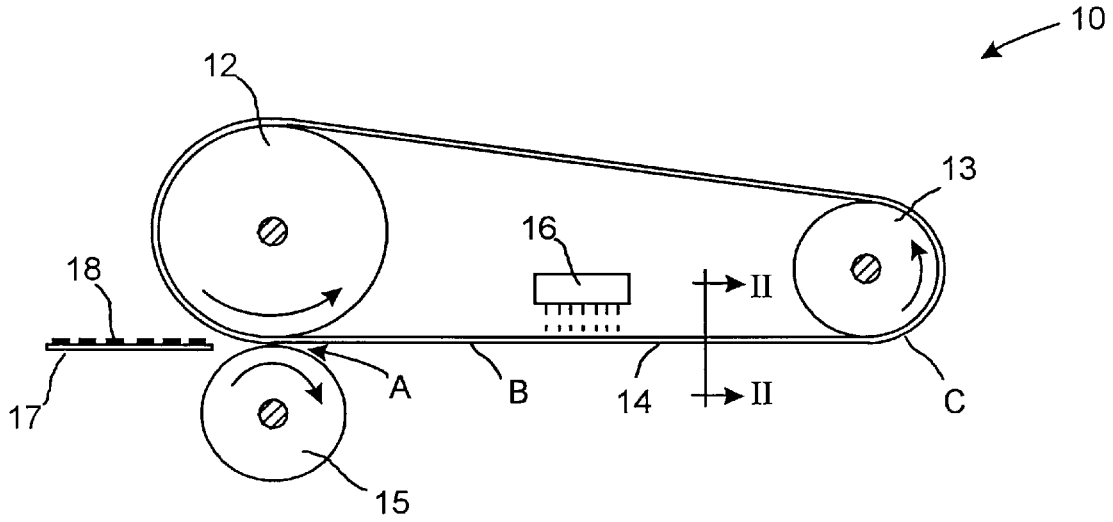
FIG. 1 shows a fuser belt system which is effective for fusing or fixing toner to a receiver surface.

FIG. 1 illustrates a typical configuration of a fuser belt system 10 using a fuser belt 14 in the form of a web. As will be subsequently described, the fuser belt 14 has an improved adhesion promoting layer. The fuser belt system 10 includes a heating roller 12 which also drives the web in conjunction with a roller 13 along an endless path. More particularly, the fuser belt 14 is trained about both the heating roller 12 and roller 13. A backup pressure roller 15 is biased against the heating roller 12. The fuser belt 14 is cooled by impinging air provided by blower 16 disposed above fuser belt 14. In operation, a receiver 17 bearing the unfused toner 18 is transported in the direction of the arrow into the nip between heating roller 12 and backup pressure roller 15, which can also or alternatively be heated if desired, where it enters a fusing zone A extending about 0.25 to 2.5 cm, preferably about 0.6 cm laterally along the fuser belt 14. Following fusing in the fusing zone A, the fused image then continues along the path of the fuser belt 14 and into the cooling zone B about 5 to 50 cm in length in the region after the fusing zone A and to roller 13. In the cooling zone B, fuser belt 14 is cooled slightly upon separation from heating roller 12 and then additionally cooled in a controlled manner by air that is caused to impinge upon fuser belt 14 as the fuser belt 14 passes around roller 13 and is transported to copy collection means such as a tray (not shown). Receiver 17 bearing the fused image is separated from the fuser belt 14 within the release zone C at a temperature where no toner image offset occurs. Separation by selecting roller 13 to have a relatively small diameter, e.g. a diameter of about 2.5 to 4 cm. As a result of passing through the three distinct zones, i.e. the fusing zone A, cooling zone B and release zone C, the fused toner image exhibits high gloss. The extent of each of the three zones and the duration of the time the toner image resides in each zone can be conveniently controlled simply by adjusting the velocity or speed of fuser belt 14. The velocity of the fuser belt 14 in a specific situation will depend on several variables, including, for example, the temperature of the fuser belt 14 in the fusing zone A, the temperature of the cooling air in the cooling zone B, and the composition of the toner particles.

Figure 2:
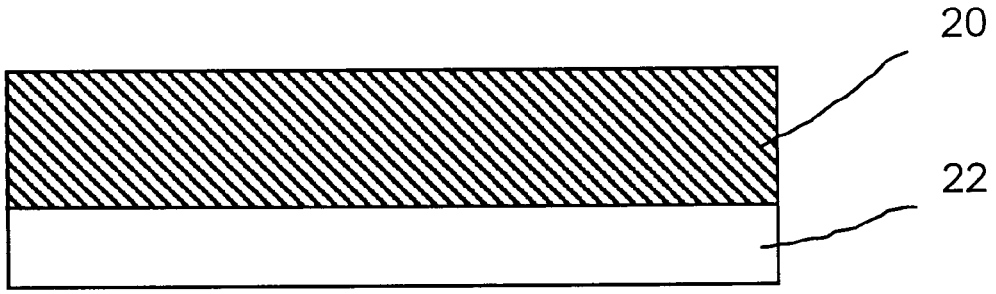
FIG. 2 is a cross-sectional view taken along lines II—II of the fuser belt of FIG. 1 and illustrating the present invention.

Turning now to FIG. 2, a cross-sectional view of the fuser belt 14 according to the present invention includes a thermally conductive substrate 20 through which heat is applied. The substrate 20 can include metal, such as, stainless steel, steel, nickel, copper, and chrome, or a polymer, such as, polyimide, polyamide-imide, polyester, polycarbonate, and polyamide, or mixtures or combinations thereof. The substrate 20 can be a smooth sheet or a meshed material, preferably it is a smooth sheet. The substrate 20 is preferably a seamless endless belt; however, belts having seams can also be used. The thickness of the substrate 20 is preferably 50 to 200 micrometers, more preferably 50 to 100 micrometers and most preferably 50 to 75 micrometers. Other materials which are also conductive will suggest themselves to those skilled in the art.

A toner release layer 22 is formed over the substrate 20. The toner release layer 22 includes an aliphatic polyurethane material which is stable at fusing temperatures. The toner release layer 22 includes an aliphatic polyurethane material selected to provide good adhesion between the substrate 20 and the toner release layer 22. The toner release layer 22 also includes a filler which is selected to improve toner fuser belt durability, and also includes a lubricant.

Polyurethanes are selected for their availability, excellent coating and film forming properties, and high surface finish gloss. Advantageously, the polyurethane is a water dispersible aliphatic polyurethane. Aliphatic polyurethanes are preferred for their thermal stability at fusing temperatures around 250° F. Water dispersible polyurethanes are well known and are prepared by chain extending a prepolymer containing terminal isocyanate groups with an active hydrogen compound, usually a diamine or diol. The prepolymer is formed by reacting a diol or polyol having terminal hydroxyl groups with excess diisocyanate or polyisocyanate. The diisocyanate or polyisocyanate is an aliphatic diisocyanate or polyisocyanate. For a more complete discussion of aliphatic diisocyanate and polyisocyanate see Zeno W. Wicks et al, Organic Coatings: Science and Technology, Vol. 1, Film Formation, Components and Appearance, A Wiley Interscience Publication, John Wiley & Sons, New York, 1992, pp. 198–200. Polyurethanes which are useful in the present invention must be cross-linked.

To permit dispersion in water, the prepolymer is functionalized with hydrophilic groups. Anionic, cationic, or nonionically stabilized prepolymers can be prepared. Anionic dispersions contain usually either carboxylate or sulphonate functionalized co-monomers, e.g., suitably hindered dihydroxy carboxylic acids (dimethylol propionic acid) or dihydroxy sulphonic acids. Cationic systems are prepared by the incorporation of diols containing tertiary nitrogen atoms, which are converted to the quaternary ammonium ion by the addition of a suitable alkylating agent or acid. Nonionically stabilized prepolymers can be prepared by the use of diol or diisocyanate co-monomers bearing pendant polyethylene oxide chains. These result in polyurethanes with stability over a wide range of pH. Nonionic and anionic groups may be combined synergistically to yield "universal" urethane dispersions. Of the above, anionic polyurethanes are by far the most significant.

One of several different techniques may be used to prepare polyurethane dispersions. For example, the prepolymer may be formed, neutralized or alkylated if appropriate, then chain extended in an excess of organic solvent such as acetone or tetrahydrofuran. The prepolymer solution is then diluted with water and the solvent removed by distillation. This is known as the "acetone" process. Alternatively, a low molecular weight prepolymer can be prepared, usually in the presence of a small amount of solvent to reduce viscosity, and chain extended with diamine just after the prepolymer is dispersed into water. The latter is termed the "prepolymer mixing" process and for economic reasons is much preferred over the former.

Polyols useful for the preparation of polyurethane dispersions include polyester polyols prepared from a diol (e.g. ethylene glycol, butylene glycol, neopentyl glycol, hexane diol or mixtures of any of the above) and a dicarboxylic acid or an anhydride (succinic acid, adipic acid, suberic acid, azelaic acid, sebacic acid, phthalic acid, isophthalic acid, maleic acid and anhydrides of these acids), polylactones from lactones such as caprolactone reacted with a diol, polyethers such as polypropylene glycols, and hydroxyl terminated polyacrylics prepared by addition polymerization of acrylic esters such as the aforementioned alkyl acrylate or methacrylates with ethylenically unsaturated monomers containing functional groups such as carboxyl, hydroxyl, cyano groups and/or glycidyl groups.

The principal aliphatic isocyanates that can be used in making aliphatic polyurethanes are 1,6-hexamethylene diisocyanate (HDI), isophorone diisocyanate (IPDI), bis(4-iso-cyanatocyclohexyl)methane (H12,MDI), tetramethyl-m-xylidene diisocyanate (TMXDI), and isopropenyldimethylbenzylisocyanate (TMI). Compounds that are reactive with the isocyanate groups and have a group capable of forming an anion are as follows: dihydroxypropionic acid, dimethylolpropionic acid, dihydroxysuccinic acid and dihydroxybenzoic acid. Other suitable compounds are the polyhydroxy acids which can be prepared by oxidizing monosaccharides, for example gluconic acid, saccharic acid, mucic acid, glucuronic acid and the like.

Suitable tertiary amines which are used to neutralize the acid and form an anionic group for water dispersibility are trimethylamine, triethylamine, dimethylaniline, diethylaniline, triphenylamine and the like. Diamines suitable for chain extension of the polyurethane include ethylenediamine, diaminopropane, hexamethylene diamine, hydrazine, amnioethylethanolamine and the like. Solvents which may be employed to aid in formation of the prepolymer and to lower its viscosity and enhance water dispersibility include methylethylketone, toluene, tetrahydofuran, acetone, dimethylformamide, N-methylpyrrolidone, and the like. Water-miscible solvents like N-methylpyrrolidone are much preferred.

Various inorganic fillers that may be used in the toner release layer 22 of the present invention, include colloidal silica, colloidal tin oxide, colloidal titanium dioxide, mica, clays, doped-metal oxides, metal oxides containing oxygen deficiencies, metal antimonates, conductive nitrides, carbides, or borides, for example, $TiO_2$, $SnO_2$, $Al_2O_3$, $ZrO_3$, $In_2O_3$, MgO, $ZnSb_2O_6$, $InSbO_4$, $TIB_2$, $ZrB_2$, $NbB_2$, $TaB_2$, $CrB_2$, MoB, WB, $LaB_6$, ZrN, TiN, TiC, and WC.

The filler concentration is in the range of from about 20 to 60 percent by volume. At volumes less than 20% there is little improvement in the scratch resistance of the toner release layer 22 while for filler concentrations greater than 60 volume % the toner release layer 22 becomes too brittle and the coating may exhibit cracking due to drying induced stresses. The filler concentration is specified in terms of volume % rather than weight % since the density of the filler particles can vary widely, for example, from about 1.5 g/cm$^3$ to as much as 7 g/cm$^3$.

The toner release layer 22 also includes a lubricant. Lubricants are used to reduce the surface energy of the polyurethane for improvement in toner release. Surface energies of polyurethanes are in the range of 40 to 50 mJ/m$^2$. It is preferable to have a surface energy of the toner release layer 22 which is 30 mJ/m$^2$ or less. Lubricants useful in the toner release layer 22 of the present invention include silicone based materials disclosed, for example, in U.S. Pat. Nos. 3,489,567, 3,080,317, 3,042,522, 4,004,927, and 4,047,958, and in British Patent Nos. 955,061 and 1,143,118; higher fatty acids and derivatives, higher alcohols and derivatives, metal salts of higher fatty acids, higher fatty acid esters, higher fatty acid amides, polyhydric alcohol esters of higher fatty acids, etc disclosed in U.S. Pat. Nos. 2,454,043, 2,732,305, 2,976,148, 3,206,311, 3,933,516, 2,588,765, 3,121,060, 3,502,473, 3,042,222, and 4,427,964, in British Patent Nos. 1,263,722, 1,198,387, 1,430,997, 1,466,304, 1,320,757, 1,320,565, and 1,320,756, and in German Patent Nos. 1,284,295 and 1,284,294; liquid paraffin and paraffin or wax like materials such as camauba wax, natural and synthetic waxes, petroleum waxes, mineral waxes and the like; perfluoro- or fluoro- or fluorochloro-containing materials, which include poly (tetrafluoroethlyene), poly(trifluorochloroethylene), poly (vinylidene fluoride), poly(trifluorochloroethylene-co-vinyl chloride), poly(meth)acrylates or poly(meth)acrylamides containing perfluoroalkyl side groups, and the like. Lubricants useful in the present invention are described in further detail in Research Disclosure No.308, published Dec. 1989, page 1006 (Kenneth Mason Publications, Ltd., Hampshire, England). In a preferred embodiment, the lubricant is a perfluoro- or fluoro- or fluorochloro-containing polymer such as Teflon™ beads (available from duPont). Such polymers are highly desirable as lubricants in the present application due to their excellent thermal properties and because they do not transfer to the receiver surface.

In addition to the polyurethane, inorganic filler, and lubricant, the toner release layer 22 in accordance with the invention may also contain suitable crosslinking agents including aldehydes, epoxy compounds, polyfunctional aziridines, vinyl sulfones, methoxyalkyl melamines, triazines, polyisocyanates, dioxane derivatives such as dihydroxydioxane, carbodiimides, and the like. The crosslinking agents react with the functional groups present on the polyurethane. The toner release layer 22 may also include surfactants, coating aids, coalescing aids, and thermal stabilizers.

The thickness of the toner release layer 22 on the belt 14 is preferably less than 50 micrometers, preferably 1 to 25 micrometers, most preferably 1 to 15 micrometers.

It is preferred that the surface energy of the coating is 20 to 30 milliJoules/meter$^2$ or less, because low surface energy belts provide better release of toner without the addition of release oils. The fuser belt 14 preferably provides a surface finish of the fused toner image of G-20 gloss greater than 70, preferably greater than 80, most preferably greater than 90. The highest gloss is achieved when smooth receivers, such as photographic papers, are used in conjunction with the fuser belts 14 of this invention. The gloss measurements can be determined using a BYK Gardner micro glossmeter set at 20 degrees by the method described in ASTM-523-67.

The substrates 20 of the fuser belts 14 are preferably solvent cleaned prior to coating the substrates 20 with the toner release layer 22. The toner release layer 22 of the invention can be applied by any of a number of well-known techniques, such as dip coating, rod coating, ring coating, spray coating, blade coating, air knife coating, gravure coating and reverse roll coating, extrusion coating, slide coating, curtain coating, and the like. After coating, the toner release layer 22 is generally dried by simple evaporation, which may be accelerated by known techniques such as convection heating. Known coating and drying methods are described in further detail in Research Disclosure No. 308, Published Dec. 1989, pages 1007 to 1008, (Kenneth Mason Publications, Ltd., Hampshire, England). After drying the toner release layer 22 is preferably placed in a convection oven at a temperature of 100° C. to 200° C., for 10 minutes to 3 hours to cure the toner release layer 22.

Aliphatic polyurethanes selected for use in the toner release layer 22 must be thermally stable at fusing temperatures employed in the electrophotographic apparatus. Typically these fusing temperatures are greater than 120° C. The suitability of a particular aliphatic polyurethane for use in the toner release layer 22 can be determined by the following simple test. A 1.0 $\mu$m thick layer of an aliphatic polyurethane containing about 10 percent by weight of a suitable crosslinking agent (such as aziridine, epoxy, carbodiimide, etc.) is coated on the substrate 20. This structure is then placed in an oven and heated at 120° C. for 20 hours. The structure is then removed from the oven and the toner release layer 22 is visually observed for signs of degradation. Degradation would be apparent if there was discoloration, cracking, bubble-formation, surface deformation, loss of adhesion to the substrate or loss of transparency. Aliphatic polyurethanes which form the toner release layer 22 and do not show any signs of degradation in this test are suitable for use in the present invention.

The invention will be better understood with reference to the following examples.

WORKING EXAMPLES

Example 1

Toner releasing layer compositions including Witcobond 232 polyurethane (water dispersible polyurethane available from Witco Corp.), CX100 (a polyfunctional aziridine crosslinking agent available from Zeneca Resins, Inc.) added at 10 percent by weight of the polyurethane and various volume concentrations of Ludox AM (colloidal silica available from duPont) were applied onto a 100 μm polyester support that had been previously coated with a vinylidene chloride-containing subbing layer. The dry coated thickness is 1 μm.

A micro-scratch tester was employed to measure the scratch resistance of the toner release layer 22. Using a conical diamond stylus of 3-micron radius, each toner release layer 22 was scratched at various loads. The toner release layer 22 should be able to sustain a minimum scratch load of about 10 mN without toner release layer 22 failure for good wear resistance. The results of scratching at 10 mN load are shown in Table 1.

In addition to the required coating strength at a 10 mN scratch load, the toner release layer 22 must be mar resistant by not having observable scratches when it is scratched at a load of 5 mN. Using a scanner, scratches generated on each coating at 5 mN load were examined. Results of the mar resistance evaluation are also tabulated in Table 1.

TABLE 1

| Polymer | Filler | Ludox AM Volume % | Toner Release Layer Failure | Mar Resistance |
|---|---|---|---|---|
| Witcobond 232 | Ludox AM | 0 | none | poor |
| Witcobond 232 | Ludox AM | 10 | none | poor |
| Witcobond 232 | Ludox AM | 20 | none | good |
| Witcobond 232 | Ludox AM | 30 | none | good |
| Witcobond 232 | Ludox AM | 40 | none | excellent |
| Witcobond 232 | Ludox AM | 50 | none | excellent |
| Witcobond 232 | Ludox AM | 65 | some | excellent |

Example 2

A seamless and uncoated polyimide resin belt 823 mm (32.4 inches) in diameter and 254 mm in width (10 inches), manufactured by Gunze Co., was cleaned with anhydrous ethanol and wiped with a lint-free cloth. Toner release layers including Witcobond 232 polyurethane, CX00 aziridine cross-linking agent and Ludox AM were coated onto the polyimide belt without or with various concentrations of perflorinated polymer particles, FEP 120 (available from duPont). FEP 120 when placed in solvents such as water becomes an aqueous dispersion of tetrafluoroethylene-hexafluoropropylene copolymer and has a particle size of about 0.1 to 0.26 μm. In an apparatus substantially as shown in FIG. 1 but having an air knife cooling means operating at 35 psig, the belt was tested without the use of a release oil for the fusing of a black thermoplastic toner powder (Ricoh NC 5006 toner) to sheets of laser print paper at a speed of 1.5 inches per second. The fusing temperature was 250° F., the release temperature was 100° F., and the nip pressure over a distance of 0.240 inches was 35 psig at 240° F. Results of fused image gloss, toner release, coating surface energy, and belt wear are reported in Table 2.

TABLE 2

| Polyurethane | Ludox AM volume % | FEP 120 Wt % | Gloss | Surface Energy (dyne/cm) | Toner Release | Belt Wear |
|---|---|---|---|---|---|---|
| Witcobond 232 | 50 | 4 | Good | 46 | Poor | Good |
| Witcobond 232 | 25 | 15 | Good | 25 | Good | Good |
| Witcobond 232 | 25 | 20 | Good | 26 | Good | Good |
| Witcobond 232 | 25 | 25 | Good | 28 | Good | Good |

The invention has been described in detail with reference to certain preferred embodiments thereof, but it should be appreciated that variations and modifications can be effected within the scope of the invention.

PARTS LIST

10 fuser belt system
12 heating roller
13 roller
14 fuser belt
15 pressure roller
16 blower
17 receiver
20 substrate
22 toner release layer

What is claimed is:

1. A toner fuser belt for use with electrophotographic apparatus comprising:

(a) a thermally conductive substrate through which heat is applied; and (b) a toner release layer formed over the substrate; and including an aliphatic cross-linked polyurethane which is stable at fusing temperatures and wherein the aliphatic cross-linked polyurethane is selected to provide good adhesion to the substrate; an inorganic material selected to increase toner fuser belt durability and being in an amount 20 to 60 percent by volume of the toner release layer; and a lubricant which reduces surface energy to thereby promote toner release of the toner release layer.

2. The toner fuser belt of claim 1 wherein the substrate is formed from materials selected from the group consisting of polyimide, polyesters, polyamide-imide, polycarbonates, and conductive metals.

3. The toner fuser belt of claim 1 wherein the inorganic material is selected from the group consisting of colloidal silica, colloidal tin oxide, colloidal titanium dioxide, mica, clays, doped-metal oxides, metal oxides containing oxygen deficiencies, metal antimonates, conductive nitrides, carbides, and borides.

4. The toner fuser belt of claim 1 wherein the lubricant is a perfluoro-, fluoro- or fluorochloro-containing polymer.

* * * * *